US008312723B2

(12) United States Patent
Pieussergues et al.

(10) Patent No.: US 8,312,723 B2
(45) Date of Patent: Nov. 20, 2012

(54) SYSTEM FOR INJECTING A MIXTURE OF AIR AND FUEL INTO A TURBOMACHINE COMBUSTION CHAMBER

(75) Inventors: Christophe Pieussergues, Nangis (FR); Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 805 days.

(21) Appl. No.: 12/333,732

(22) Filed: Dec. 12, 2008

(65) Prior Publication Data

US 2009/0151357 A1 Jun. 18, 2009

(30) Foreign Application Priority Data

Dec. 14, 2007 (FR) ..... 07 08703

(51) Int. Cl.
*F23R 3/30* (2006.01)

(52) U.S. Cl. ..... 60/737; 60/748

(58) Field of Classification Search ..... 60/748, 60/737

See application file for complete search history.

(56) References Cited

U.S. PATENT DOCUMENTS

| | | | | |
|---|---|---|---|---|
| 3,121,996 | A * | 2/1964 | Smith | 60/748 |
| 4,726,182 | A * | 2/1988 | Barbier et al. | 60/748 |
| 4,754,600 | A * | 7/1988 | Barbier et al. | 60/748 |
| 4,766,722 | A * | 8/1988 | Bayle-Laboure et al. | 60/752 |
| 4,809,512 | A * | 3/1989 | Barbier et al. | 60/748 |
| 5,592,819 | A * | 1/1997 | Ansart et al. | 60/737 |
| 6,609,377 | B2 * | 8/2003 | Durbin et al. | 60/748 |
| 2005/0229600 | A1 * | 10/2005 | Kastrup et al. | 60/748 |
| 2006/0168967 | A1 * | 8/2006 | Simons et al. | 60/752 |

FOREIGN PATENT DOCUMENTS

| | | |
|---|---|---|
| EP | 1 586 819 A2 | 10/2005 |
| EP | 1 790 908 A2 | 5/2007 |
| EP | 1 857 741 A1 | 11/2007 |

OTHER PUBLICATIONS

U.S. Appl. No. 12/165,951, filed Jul. 1, 2008, Cayre et al.
U.S. Appl. No. 13/143,357, filed Jul. 6, 2011, Sandelis.

* cited by examiner

*Primary Examiner* — Ted Kim
(74) *Attorney, Agent, or Firm* — Oblon, Spivak, McClelland, Maier & Neustadt, L.L.P.

(57) ABSTRACT

A system for injecting a mixture of air and fuel into a turbomachine combustion chamber is disclosed. The system includes a fuel injector and a Venturi with an interior surface delimiting a premixing chamber. The Venturi includes an internal annular airflow cavity which is connected by air outlet ducts to the premixing chamber. The air outlet ducts open onto the interior surface of the Venturi so as to prevent to deposition of soot and the formation of coke on this surface.

9 Claims, 3 Drawing Sheets

SYSTEM FOR INJECTING A MIXTURE OF AIR AND FUEL INTO A TURBOMACHINE COMBUSTION CHAMBER

The present invention relates to a system for injecting a mixture of air and fuel into a combustion chamber of a turbomachine, such as an aircraft turbojet or turboprop engine.

BACKGROUND OF THE INVENTION

An injection system of this type generally comprises a fuel injector and primary and secondary swirlers which are positioned downstream of the injector, coaxial therewith, and which each delimit a radial stream of air downstream of the injection of fuel so as to create the mixture of air and fuel that is to be injected into and then burnt in the combustion chamber. The airflows from the two swirlers are delimited by a Venturi interposed between the two swirlers and a bowl of frustoconical shape which is mounted downstream of the swirlers and which accelerate the flow of the air/fuel mixture towards the combustion chamber.

The Venturi has an interior surface with a narrowing or a constriction delimiting a premixing chamber in which some of the fuel ejected by the injector and the stream of air delivered by the primary swirler are mixed.

It has already been found that soot is deposited and coke is formed on this interior surface of the Venturi, and this leads to numerous disadvantages:

- the deposits of soot and coke may form hot spots which shorten the life of the Venturi,
- these deposits may also disrupt the airflow through the Venturi, the injection of fuel and the mixing of the fuel with the stream of air from the primary swirler, and
- the presence of coke and of soot also increases the production of harmful gases which are discharged into the atmosphere.

SUMMARY OF THE INVENTION

It is a particular object of the present invention to provide a simple, effective and economic solution to these problems of the prior art.

To this end, the invention proposes a system for injecting a mixture of air and fuel into a turbomachine combustion chamber, comprising a fuel injector and a Venturi positioned downstream of the injector, coaxial therewith, the Venturi comprising an interior surface delimiting a premixing chamber in which fuel is mixed with a stream of air taken from an external space and passing through a primary swirler positioned upstream of the Venturi, wherein the Venturi comprises an internal annular airflow cavity, this cavity being connected by air inlet ducts to the external space and by air outlet ducts to the premixing chamber, the air outlet ducts opening onto the interior surface of the Venturi so as to prevent the deposition of soot and the formation of coke on this surface.

According to the invention, a flow of air from an external space flows through the internal cavity of the Venturi and is then injected into the premixing chamber through air outlet ducts that open onto the interior surface of the Venturi, so as to form a film of air near this surface to oppose the deposition of soot and the formation of coke on this surface. The airflow injected into the premixing chamber is high enough to prevent the air/fuel mixture from coming into contact with the interior surface of the Venturi, but is also low enough not to impede the airflow and the injection of fuel into the Venturi and not to cause boundary layer separation at the outlet from the Venturi.

The airflow through the internal cavity of the Venturi represents about 0.5 to 1% of the airflow fed to the injection system.

According to another feature of the invention, the Venturi comprises, at its upstream end, an annular rim extending radially outwards and separating the primary swirler from a secondary swirler for the passage of a second stream of air, the annular cavity extending as far as the rim of the Venturi. In this case, the annular cavity has a substantially L-shaped cross section.

According to one embodiment of the invention, the Venturi is formed of two annular components of substantially L-shaped cross section which are fitted coaxially one inside the other and are joined together by brazing or by welding, the first and second components between them delimiting the annular airflow cavity.

The first component extends upstream of and inside the second component and comprises a substantially radial upstream annular wall which is connected at its internal periphery to a substantially cylindrical downstream wall in which the air outlet ducts are formed. The second component comprises a substantially radial upstream annular wall which is connected at its internal periphery to a substantially cylindrical downstream wall, the radial wall being fixed at its external periphery to the external periphery of the radial wall of the first component, and its cylindrical wall being fixed at its downstream end to the downstream end of the cylindrical wall of the first component.

At least part of the air inlet ducts may run substantially radially with respect to the axis of the injector and be formed at the external periphery of the radial wall of one or each component. Air from the external space then passes radially inwards directly into the internal cavity of the Venturi.

As an alternative or as an additional feature, at least part of the air inlet ducts run substantially parallel to the axis of the injector and are formed through the vanes of the secondary swirler and the radial wall of the second component. In this case, air from the external space flows axially in the upstream direction through the ducts formed in the vanes of the secondary swirler and in the radial wall of the second component as far as the internal cavity of the Venturi.

According to another feature of the invention, the air outlet ducts are inclined in the axial and circumferential direction with respect to the axis of the injector, in the same direction as the vanes of the primary swirler, so that the air leaving these ducts does not disturb the flow of air delivered by the primary swirler and does not impinge upon the head of the injector. The invention therefore makes it possible to prevent coke from forming on the Venturi without altering the flow of air and the injection of fuel within the Venturi.

The axial angle of inclination of each outlet duct formed between the axis of this duct and the axis of the injector ranges for example between about 10 and 40°, this angle being measured in a plane passing through the axis of the injector.

The circumferential angle of inclination of each outlet duct, formed between the axis of this duct and a plane passing through the axis of the injector, ranges for example between about 50 and 75°, this angle being measured in a plane perpendicular to the axis of the injector.

As a preference, the mouths of the air outlet ducts are positioned uniformly about the axis of the injector and are split into 1, 2, 3 or 4 annular rows spaced axially apart. The angles of inclination of the air ducts in the axial and circumferential direction may vary from one row to another.

The injection system comprises, for example, between 10 and 30 air inlet ducts and between 10 and 30 air outlet ducts.

The invention also relates to a turbomachine such as an aircraft turbojet or turboprop engine, comprising an injection system as described hereinabove.

The invention further relates to a Venturi for an injection system as described hereinabove, comprising an interior surface exhibiting a throat, wherein it is formed of two annular components of substantially L-shaped cross section which are fixed coaxially one inside the other and which between them delimit an internal airflow cavity, the internal annular component comprising a cylindrical wall with air outlet ducts connected at one of their ends to the internal cavity and opening at the other of their ends onto the interior surface, and the external annular wall comprising a radial annular wall which at its external periphery has air inlet ducts connected at one of their ends to the internal cavity.

BRIEF DESCRIPTION OF THE DRAWINGS

The invention will be better understood and further features, details and advantages thereof will become more clearly apparent upon reading the description which follows, given by way of nonlimiting example and with reference to the attached drawings in which.

MORE DETAILED DESCRIPTION

Figure 1:
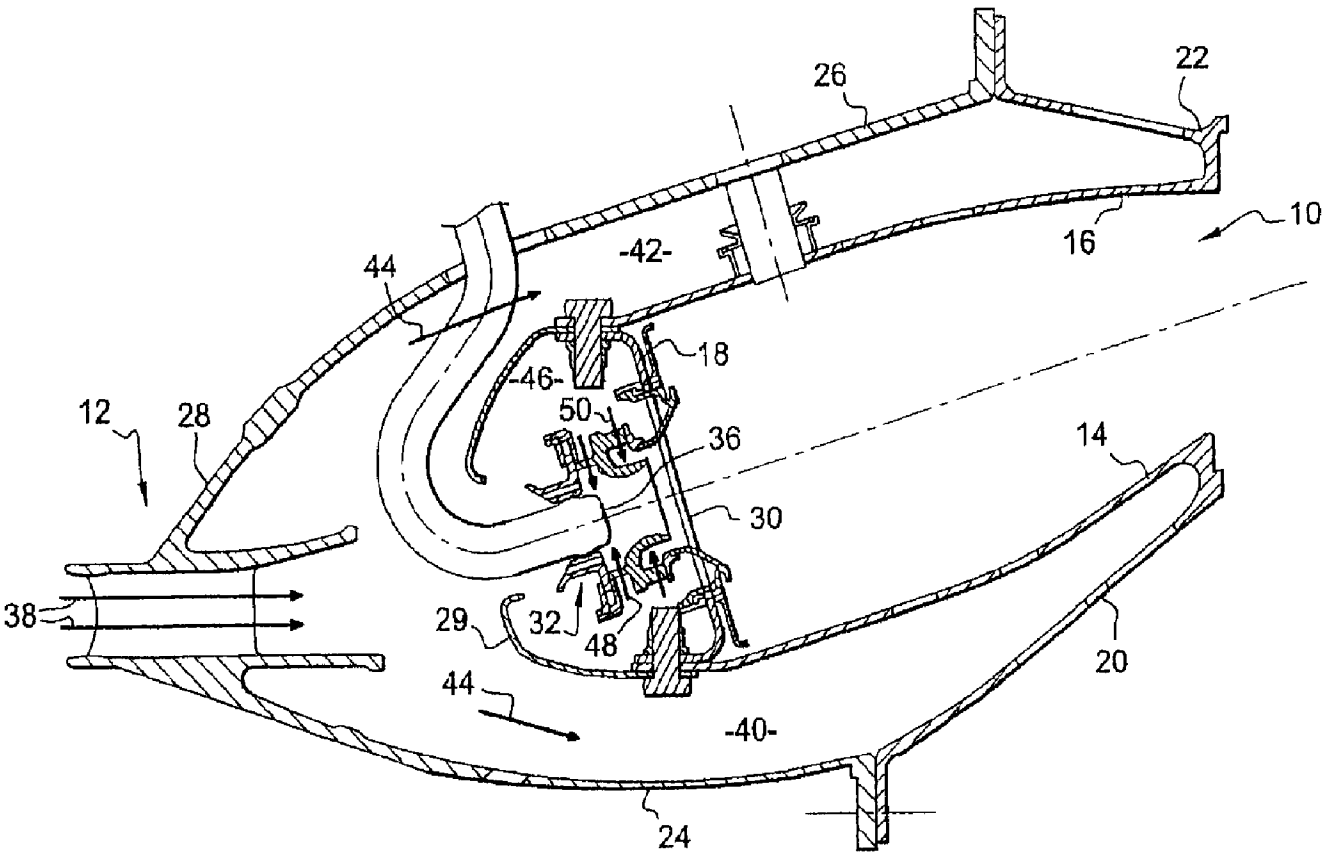
Fig. 1 BACKGROUND ART
FIG. 1 is a schematic half view in axial section of a diffuser and of a combustion chamber of a turbomachine.

FIG. 1 depicts an annular combustion chamber 10 of a turbomachine such as an aircraft turbojet or turboprop engine, this chamber being positioned at the outlet of a diffuser 12 itself situated at the outlet of a compressor (not depicted). The chamber 10 has an internal axisymmetric wall 14 and an external axisymmetric wall 16 which are connected at the upstream end to an annular chamber end wall 18 and fixed at the downstream end by respective internal 20 and external 22 frustoconical shell rings to an internal frustoconical partition wall 24 of the diffuser and to an external casing 26 of the chamber, respectively, the upstream end of this casing 26 being connected to an external frustoconical partition wall 28 of the diffuser.

An annular cowling 29 is fixed to the upstream ends of the walls 14, 16 and 18 of the chamber and has air passage orifices aligned with openings 30 in the chamber end wall 18, in which openings systems 32 for injecting a mixture of air and of fuel into the chamber are mounted, the air coming from the diffuser 12 and the fuel being conveyed by injectors (not depicted) fixed to the external casing 26 and uniformly distributed about the axis of the chamber. Each injector comprises a fuel injection head 36 aligned with the axis of the corresponding opening 30.

Some of the airflow 38 provided by the compressor and leaving the diffuser 12 is fed into internal 40 and external 42 annular ducts that bypass the combustion chamber 10 (arrows 44). The remainder of the airflow enters the annular space 46 delimited by the cowling 29, passes into the injection system 32 (arrows 48 and 50) and is then mixed with the fuel carried by the injector and sprayed into the combustion chamber.

Figure 2:
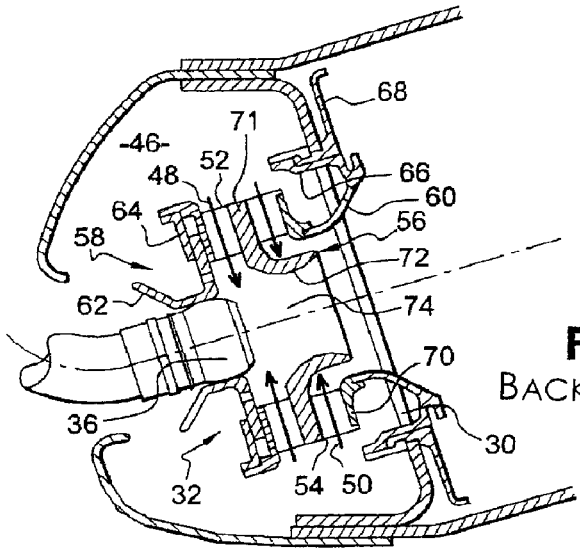
Fig. 2 BACKGROUND ART
FIG. 2 is an enlarged part view of FIG. 1 and depicts a system for injecting a mixture of air and fuel according to the prior art.

The injection system 32, best visible in FIG. 2, comprises two coaxial turbulence-inducting swirlers, one upstream 52, and one downstream 54, which are separated from one another by a Venturi 56 and which are connected upstream to means 58 of centring and of guiding the head 36 of the injector, and downstream to a mixing bowl 60 which is mounted axially in the opening 30 in the chamber end wall 18.

The swirlers 52, 54 each comprise a plurality of vanes running radially about the axis of the swirler and uniformly distributed about this axis so as to deliver a stream of swirling air 48, 50 downstream of the injection head 36.

The means 58 of guiding the injection head 36 of the injector comprise a ring 62 through which the injection head 36 passes axially and which is mounted to slide radially in a sleeve 64 attached to the vanes of the primary swirler 52.

The mixing bowl 60 has a substantially frustoconical wall widest at the downstream end and connected at its downstream end to a cylindrical rim 66 extending upstream and mounted axially in the opening 30 in the chamber end wall 18 with an annular deflector 68. The upstream end of the frustoconical wall 60 of the bowl is connected to an intermediate annular component 70 attached to the vanes of the secondary swirler 54.

The Venturi 56 has a substantially L-shaped cross section and at its upstream end has a substantially radial annular rim 71 which is inserted axially between the two swirlers 52, 54 and which, together with the sleeve 64 located upstream, axially delimits the annular passage through which the stream of air 48 passes in the primary swirler 52 and, together with the annular component 70 located downstream, delimits the annular passage through which the stream of air 50 passes into the secondary swirler 54. The Venturi 56 extends axially downstream inside the secondary swirler 54 and separates the airflows from the upstream 52 and downstream 54 swirlers.

The Venturi 56 comprises an interior cylindrical surface 72 that has a throat and delimits a premixing chamber 74 in which some of the injected fuel mixes with the stream of air 48 delivered by the primary swirler 52. This air/fuel premixture then mixes downstream of the Venturi with the stream of air 50 from the secondary swirler 54 to form a cone of atomized fuel inside the chamber.

In operation, the air/fuel premixture formed in the chamber 74 can come into contact with the interior surface 72 of the Venturi and cause soot to be deposited and coke to be formed on this surface, these being liable to reduce the life of the Venturi 56.

The invention provides a remedy to this problem thanks to the formation of a film of air on the interior surface 72 of the Venturi which opposes the deposition of coke and of soot on this surface. This result is obtained by means of a hollow Venturi comprising an internal annular airflow cavity, this cavity being supplied with air from the external space 46 and being connected to air outlet ducts opening onto the interior surface 72 of the Venturi.

Figure 3:
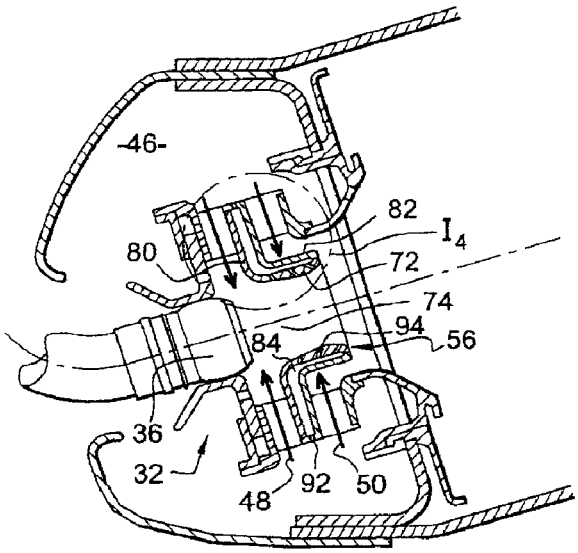
FIG. 3 is a schematic view corresponding to FIG. 2 and represents one embodiment of the injection system according to the invention.
Figure 4:
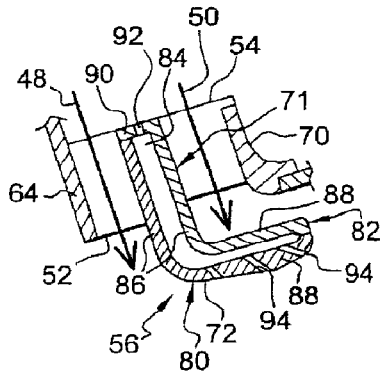
FIG. 4 is an enlarged view of detail $I_4$ of FIG. 3.

In the exemplary embodiment depicted in FIGS. 3 and 4, the Venturi 56 is formed of two annular components 80, 82 of substantially L-shaped cross section which are fixed coaxially one inside the other and which between them delimit the annular airflow cavity 84.

This cavity 84 also has a substantially L-shaped cross section and comprises a cylindrical portion which runs axially inside the Venturi, over more or less its entire axial dimension, and which is connected at its upstream end to a radial portion which extends inside the rim of the Venturi, over more or less its entire radial dimension.

Each component 80, 82 comprises a substantially radial upstream annular wall 86 which is connected at its internal periphery to a substantially cylindrical downstream wall 88. The radial walls 86 of the components 80, 82 form the annular rim 71 of the Venturi.

The component 82 situated downstream and on the outside further comprises a cylindrical rim 90 which extends in the upstream direction from the external periphery of the radial wall 86 and which is brazed or welded to the external periphery of the radial wall 86 of the other component 80.

This cylindrical rim 88 has substantially radial air inlet orifices or ducts 92 which provide fluidic communication between the space 46 and the internal cavity 84 of the Venturi. The injection system 32 comprises, for example, between 10 and 30 ducts 92 which are uniformly distributed about the axis of the Venturi.

The downstream end of the cylindrical wall 88 of the component 82 is brazed or welded to the downstream end of the cylindrical wall of the other component.

The cylindrical wall 88 of the component 80 located upstream and on the inside comprises air outlet orifices or ducts 94 which open at one of their ends onto the interior surface 72 of the Venturi and at the other of their ends into the internal cavity 84 to provide fluidic communication between this cavity 84 and the premixing chamber 74.

The injection system 32 comprises, for example, between 10 and 30 ducts 94 which are split into annular rows, for example three of these in the example depicted, which are axially spaced apart. The air ducts 94 in each row are uniformly spaced apart from one another about the axis of the injection head.

By way of example, the angle formed between the axis of each outlet duct 94 and the axis of the injection head 36 ranges between about 10 and 40°, this angle being measured in a plane passing through the axis of the injection head. The angle formed between the axis of each outlet duct 94 and a plane passing through the axis of the injection head ranges between about 50 and 75°, this angle being measured in a plane perpendicular to the axis of the injection head.

The ducts 94 of one and the same annular row of ducts have the same angles of inclination in the axial and circumferential directions, but these angles may differ from the angles of inclination of the ducts of the or each other row. The angle of inclination in the axial direction of the ducts 94 of the first row situated upstream may, for example, be smaller than that of the ducts of the third row situated further downstream (FIG. 4).

Figure 5:
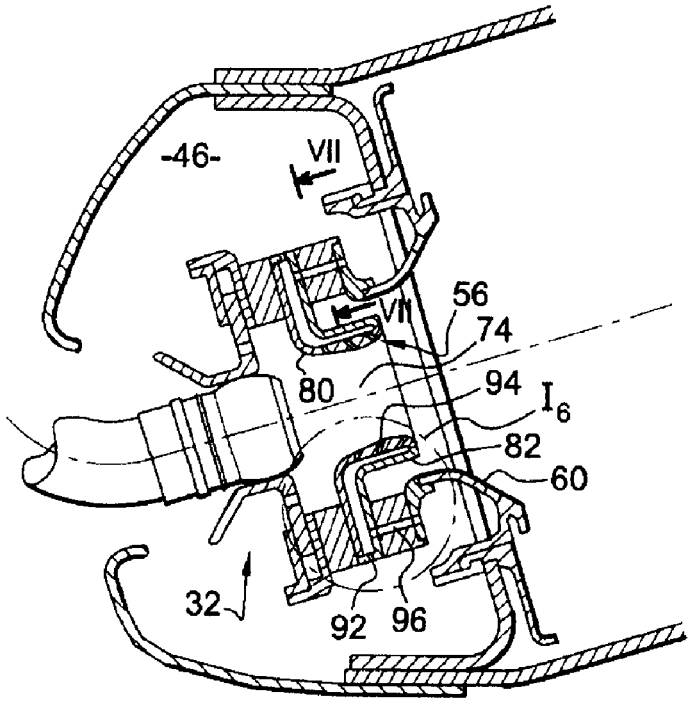
FIG. 5 is a schematic view corresponding to FIG. 2 and depicts an alternative form of embodiment of the injection system according to the invention.
Figure 6:
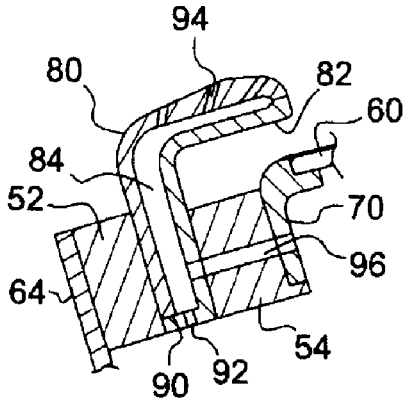
FIG. 6 is an enlarged view of detail $I_6$ of FIG. 5.
Figure 7:
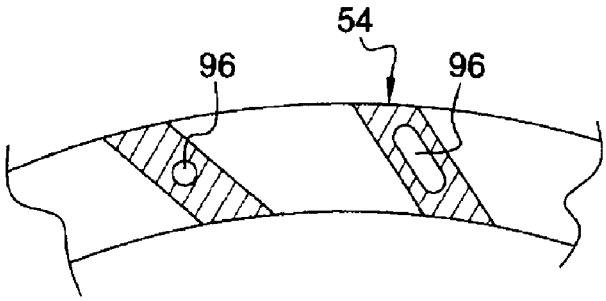
FIG. 7 is a view in section on VII-VII of FIG. 4, on a larger scale.

FIGS. 5 to 7 depict an alternative form of embodiment of the invention which comprises, in addition to the features described with reference to FIGS. 3 and 4, additional air inlet ducts 96 leading into the internal cavity 84 of the Venturi. These ducts 96 run substantially parallel to the axis of the Venturi and also connect the internal cavity 84 of the Venturi to the external space 46.

In the example depicted, these ducts 96 run through the radial wall of the component 82 situated downstream and on the outside, through at least some of the vanes of the secondary swirler 54, and through the annular element 70. The ducts 96 at their upstream ends open into the internal cavity 84 and at their downstream ends open into an annular space delimited by the element 70 and the bowl 60, this annular space communicating with the external space 46. The injection system comprises, for example, between 10 and 30 ducts 96.

As depicted in FIG. 7, the ducts 96 may have a cross section of circular or oblong shape. The ducts 92 and 94 described above may also be circular or oblong in cross section. The dimensions of these ducts 92, 94, 96 are determined in particular according to the amount of airflow through the cavity. Typically, they are about 1 to 2 mm in diameter. The airflow through the cavity 84 represents about 0.5 to 1% of the airflow fed into the injection system 32.

According to yet another alternative form of embodiment which has not been depicted, the internal cavity 84 is connected to the external space 46 only via the axial air inlet ducts 96.

The invention claimed is:

1. A system for injecting a mixture of air and fuel into a turbomachine combustion chamber, comprising:

a fuel injector and a Venturi positioned downstream of the injector, coaxial therewith, the Venturi comprising an interior surface delimiting a premixing chamber in which fuel is mixed with a stream of air taken from an external space and passing through a primary swirler positioned upstream of the Venturi, wherein the Venturi comprises an internal annular air-flow cavity, the cavity being connected by air inlet ducts to the external space and by air outlet ducts to the premixing chamber, the air outlet ducts opening onto the interior surface of the Venturi so as to prevent the deposition of soot and the formation of coke on the surface, wherein the Venturi comprises, at its upstream end, an annular rim extending radially outwards and separating the primary swirler from a secondary swirler for the passage of a second stream of air, the annular cavity extending as far as the rim of the Venturi, wherein the Venturi is formed of two annular components of substantially L-shaped cross section which are fitted coaxially one inside the other and are joined together by brazing or by welding, the first and second components between them delimiting the annular airflow cavity, wherein the first component extends upstream of and inside the second component, the first component having a substantially radial upstream annular wall which is connected at its internal periphery to a substantially cylindrical downstream wall in which the air outlet ducts are formed, wherein the second component comprises a substantially radial upstream annular wall which is connected at its internal periphery to a substantially cylindrical downstream wall, the radial wall being fixed at its external periphery to an external periphery of the radial wall of the first component, and its cylindrical wall being fixed at its downstream end to a downstream end of the cylindrical wall of the first component, and wherein at least part of the air inlet ducts run substantially radially with respect to an axis of the injector and are formed at the external periphery of the radial wall of one or each component and/or run substantially parallel to the axis of the injector and are formed through the vanes of the secondary swirler and the radial wall of the second component.

2. The injection system according to claim 1, wherein the annular cavity of the Venturi has a substantially L-shaped cross section.

3. The injection system according to claim 1, wherein the air outlet ducts are inclined in the axial and circumferential direction with respect to the axis of the injector, in the same direction as the vanes of the primary swirler.

4. The injection system according to claim 3, wherein the axial angle of inclination of each outlet duct formed between an axis of the duct and the axis of the injector ranges between about 10 and 40°, the angle being measured in a plane passing through the axis of the injector.

5. The injection system according to claim 3, wherein the circumferential angle of inclination of each outlet duct, formed between an axis of the duct and a plane passing through the axis of the injector, ranges between about 50 and 75°, the angle being measured in a plane perpendicular to the axis of the injector.

6. The injection system according to claim 1, wherein mouths of the air outlet ducts are positioned uniformly about the axis of the injector and are split into 1, 2, 3 or 4 annular rows spaced axially apart.

7. The injection system according to claim 1, comprising between 10 and 30 air inlet ducts and between 10 and 30 air outlet ducts.

8. A turbomachine comprising an injection system according to claim 1.

9. A Venturi for a system for injecting a mixture of air and fuel into a turbomachine combustion chamber, comprising:

an interior surface comprising an interior surface delimiting a premixing chamber and exhibiting a throat; and an annular rim, at an upstream end of the Venturi, extending radially outwards, wherein the Venturi is formed of first and second annular components of substantially L-shaped cross section which are fixed coaxially one inside the other and which between them delimit an internal air-flow cavity which is connected by air inlet ducts to an external space and by air outlet ducts to the premixing chamber, the first annular component extending upstream of and inside the second component and comprising a substantially radial upstream annular wall which is connected at its internal periphery to a substantially cylindrical downstream wall in which the air outlet ducts are formed, the outlet ducts being connected at one of their ends to the internal cavity and opening at the other of their ends onto the interior surface, the second component comprises a substantially radial upstream annular wall which is connected at its internal periphery to a substantially cylindrical downstream wall, the radial wall being fixed at its external periphery to an external periphery of the radial wall of the first component, and its cylindrical wall being fixed at its downstream end to a downstream end of the cylindrical wall of the first component, and at least one of the annular components comprising the air inlet ducts which are connected at one of their ends to the internal cavity, and wherein at least part of said air inlet ducts run substantially radially with respect to an axis of an injector and are formed at an external periphery of the radial wall of one or each annular component, and/or run substantially parallel to an axis of the Venturi and are formed through a radial wall of the second annular component.

* * * * *